US008297269B2

(12) United States Patent
Hu

(10) Patent No.: US 8,297,269 B2
(45) Date of Patent: Oct. 30, 2012

(54) GUN BOLT TRANSMISSION MECHANISM FOR ELECTRIC TOY GUN

(76) Inventor: Shih-Che Hu, Yung Kang (TW)

( * ) Notice: Subject to any disclaimer, the term of this patent is extended or adjusted under 35 U.S.C. 154(b) by 347 days.

(21) Appl. No.: 12/703,397

(22) Filed: Feb. 10, 2010

(65) Prior Publication Data

US 2011/0192387 A1 Aug. 11, 2011

(51) Int. Cl.
*F41B 11/00* (2006.01)

(52) U.S. Cl. ..... 124/67; 124/66; 124/32

(58) Field of Classification Search ..... 124/65–68, 124/71–77, 80; 446/473, 484
See application file for complete search history.

(56) References Cited

U.S. PATENT DOCUMENTS

| | | | | |
|---|---|---|---|---|
| 5,261,384 | A * | 11/1993 | Hu | 124/66 |
| 6,564,788 | B1 * | 5/2003 | Hu | 124/66 |
| 7,100,592 | B1 * | 9/2006 | Yang | 124/67 |
| 7,694,448 | B2 * | 4/2010 | Iwasawa | 124/54 |
| 7,841,329 | B2 * | 11/2010 | Yang | 124/66 |
| 7,946,283 | B2 * | 5/2011 | Lee et al. | 124/67 |
| 7,963,281 | B2 * | 6/2011 | Pong | 124/67 |
| 7,975,682 | B2 * | 7/2011 | Yang | 124/67 |
| 2003/0098019 | A1 * | 5/2003 | Hu | 124/66 |
| 2006/0231083 | A1 * | 10/2006 | Tsurumoto | 124/66 |
| 2006/0243263 | A1 * | 11/2006 | Tsurumoto | 124/66 |
| 2007/0261689 | A1 * | 11/2007 | Tai et al. | 124/67 |
| 2007/0283941 | A1 * | 12/2007 | Tai et al. | 124/67 |
| 2007/0283942 | A1 * | 12/2007 | Tai et al. | 124/67 |
| 2008/0078369 | A1 * | 4/2008 | Yeung | 124/67 |
| 2009/0217919 | A1 * | 9/2009 | Pong Chun Chung | 124/80 |
| 2010/0065032 | A1 * | 3/2010 | Yang | 124/27 |
| 2010/0065033 | A1 * | 3/2010 | Yang | 124/66 |

FOREIGN PATENT DOCUMENTS

| | | | |
|---|---|---|---|
| EP | 2096400 | A2 * | 9/2009 |
| GB | 2264066 | A * | 8/1993 |

* cited by examiner

*Primary Examiner* — Jonathan C Weber
(74) *Attorney, Agent, or Firm* — Pro-Techtor Int'l Services

(57) ABSTRACT

A gun bolt transmission mechanism used in an electric toy gun is disclosed to include a driving member pivotally mounted in the gun body of the electric toy gun at one side of a bolt body that accommodates a piston set, and a push rod located on a gear set for moving the driving member to push the bolt body backwards during rotation of the gear set and for enabling the bolt body to be returned after rotation of the gear set through a predetermined angle to disengage the push rod from the driving member. Thus, the bolt body simulates the motion of a real gun and the movement of the piston set does not interfere with the movement of the bolt body.

3 Claims, 9 Drawing Sheets

GUN BOLT TRANSMISSION MECHANISM FOR ELECTRIC TOY GUN

BACKGROUND OF THE INVENTION

1. Field of the Invention

The present invention relates to electric toy guns and more particularly, to a gun bolt transmission mechanism for electric toy gun, which enables the bolt body to be moved accurately to simulate the motion of a real gun.

2. Description of the Related Art

The driving principle of an electric toy gun is different from that of a toy air-soft gun. With respect to the driving system in an electric toy gun, triggering the trigger causes displacement of a conduction control holder into contact with an electric terminal holder, thereby starting a firing mechanism. When firing a bullet, a battery-operated gear set 10 is started to move a piston set 30 in the gun body 20 toward the rear side (see FIG. 1). The piston set 30 is loaded with a spring member 301 that is capable of returning the piston set 30. When the gear set 10 reaches a predetermined position, the piston set 30 is released from the gear set 10 and moved forwardly by the spring member 301 to its former position. At this time, a compressed gas is discharged to drive an air-soft bullet out of the gun barrel of the toy gun.

In a conventional electric toy gun, the component parts of the aforesaid driving system are kept on the inside of the gun body. When viewing from the outside, people cannot see the motion of the component parts of the aforesaid driving system. Thus, the firing of an electric toy gun cannot simulate the action of a real gun. This drawback limits the application of conventional electric toy guns in certain fields, for example, in military training.

Taiwan patent publication M343786 discloses an improved design to eliminate the aforesaid drawback. According to this design, as shown in FIG. 2, a de-arm device (bolt body) 40 is disposed outside the piston set 30 and movable backwards by the piston set 30 to simulate the firing action of a real gun. The de-arm device (bolt body) 40 is movable with the piston set 30 synchronously (i.e., the de-arm device 40 moves forwards or backwards subject to the displacement of the piston set 30). However, when one toy bullet is fired, the inertia effect of the gear set 10 will move the piston set 30, thus the piston set 30 may be not stopped at the front-most point, leading to inaccurate positioning of the de-arm device (bolt body) 40. Further, the gun body 20 has a see-through portion through which people can see the motion of the de-arm device (bolt body) 40 in the gun body 20. However, inaccurate positioning of the de-arm device (bolt body) 40 in the gun body 20 lowers the simulation credibility. Therefore, an improvement in this regard is necessary.

SUMMARY OF THE INVENTION

The present invention has been accomplished under the circumstances in view. It is one object of the present invention to provide a gun bolt transmission mechanism, which prevents interference of the movement of the piston set with the movement of the bolt body, enabling the bolt body to be moved accurately to simulate the motion of a real gun.

To achieve this and other objects of the present invention, a gun bolt transmission mechanism is installed in the gun body of an electric toy gun, comprising a gear set, a piston set, a bolt body and a driving member. The gear set is adapted for moving the piston set backwards. The gear set comprises a first gearwheel. The piston set is mounted in the bolt body, having loaded thereon a first spring member. The first spring member is adapted for returning the piston set after each backward movement of the piston set. The bolt body has loaded thereon a second spring member. The second spring member is adapted for returning the bolt body after each backward movement of the bolt body. Further, the bolt body has a driven portion. The driving member has a driving portion. The first gearwheel of the gear set has a push rod for moving the driving member for causing driving portion to push the driven portion and to further move the bolt body backwards during rotation of the first gearwheel and for enabling the bolt body to be returned forwardly by the second spring member when the first gearwheel is rotated to a predetermined angle where the push rod is disengaged from the driving member.

Further, the driving member has an extension portion movable by the push rod of the first gearwheel. Further, the bolt body is returned forwardly by the second spring member when the push rod is disengaged from the extension portion after rotation of the first gearwheel to a predetermined angle. Further, the first gearwheel has a gear sector meshed with the piston set for moving the piston set.

Further, the driving member is pivotally connected to the inside wall of the gun body. Further, the driving member has a pivot hole pivotally connected to the inside wall of the gun body by a pivot pin, and an arched slot coupled to a fixed guide rod at the inside wall of the gun body for guiding rotary motion of the driving member about the pivot pin within a predetermined angle. Further, the bolt body has a side hole, and the driven portion is disposed in the side hole of the bolt body.

In conclusion, this invention uses a separate driving member to move the bolt body upon rotation of the gear set that carries a push rod for moving the driving member. Thus, there is no any linking relationship between the force to move the piston set backwards and the force to move the bolt body backwards, i.e., the movement of the bolt body is free from the movement of the piston set. Therefore, the displacement of the bolt body simulates the motion of a real gun, and the return action of the bolt body is accurate.

DETAILED DESCRIPTION OF THE PREFERRED EMBODIMENT

Figure 1:
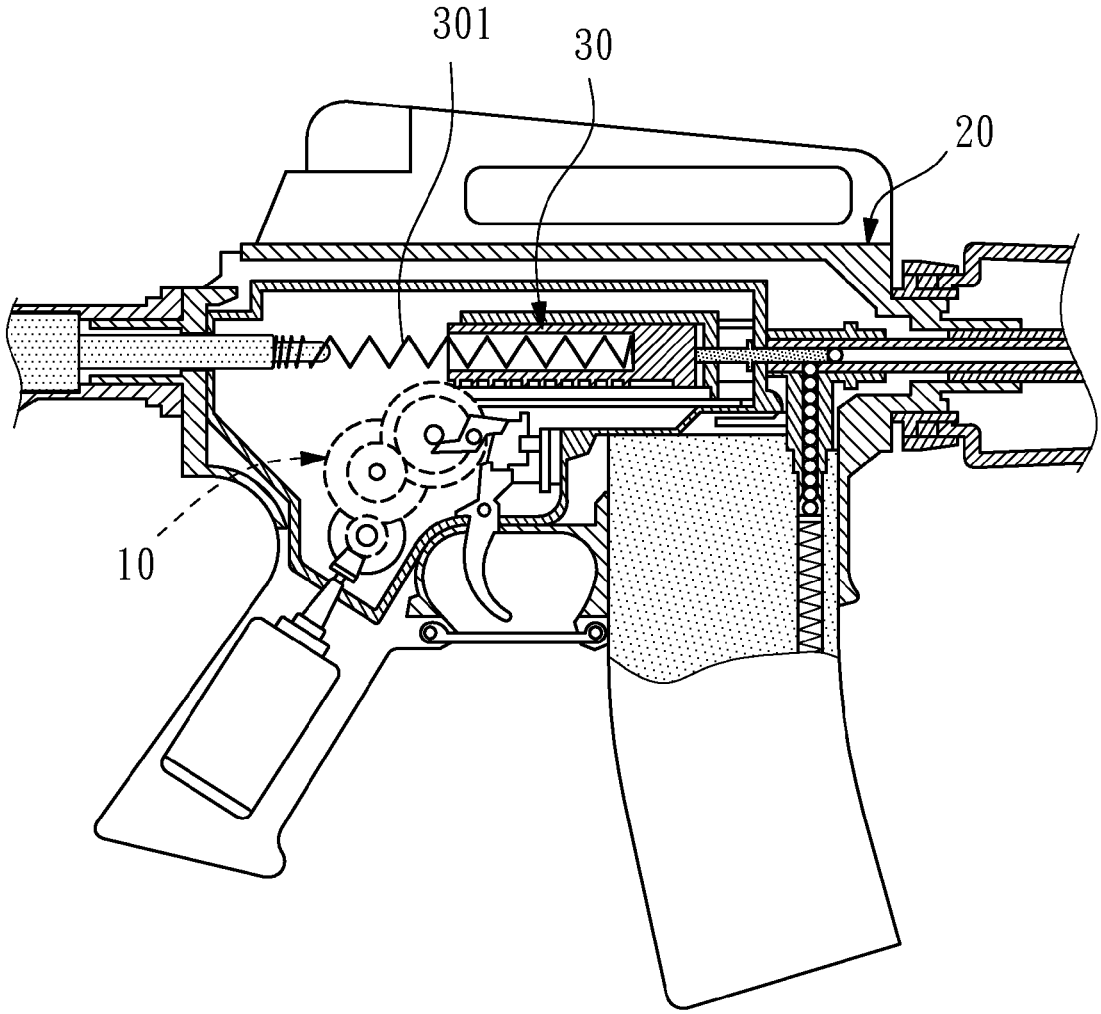
FIG. 1 (Prior Art)
FIG. 1 is a schematic sectional side view of a toy gun according to the prior art.
Figure 2:
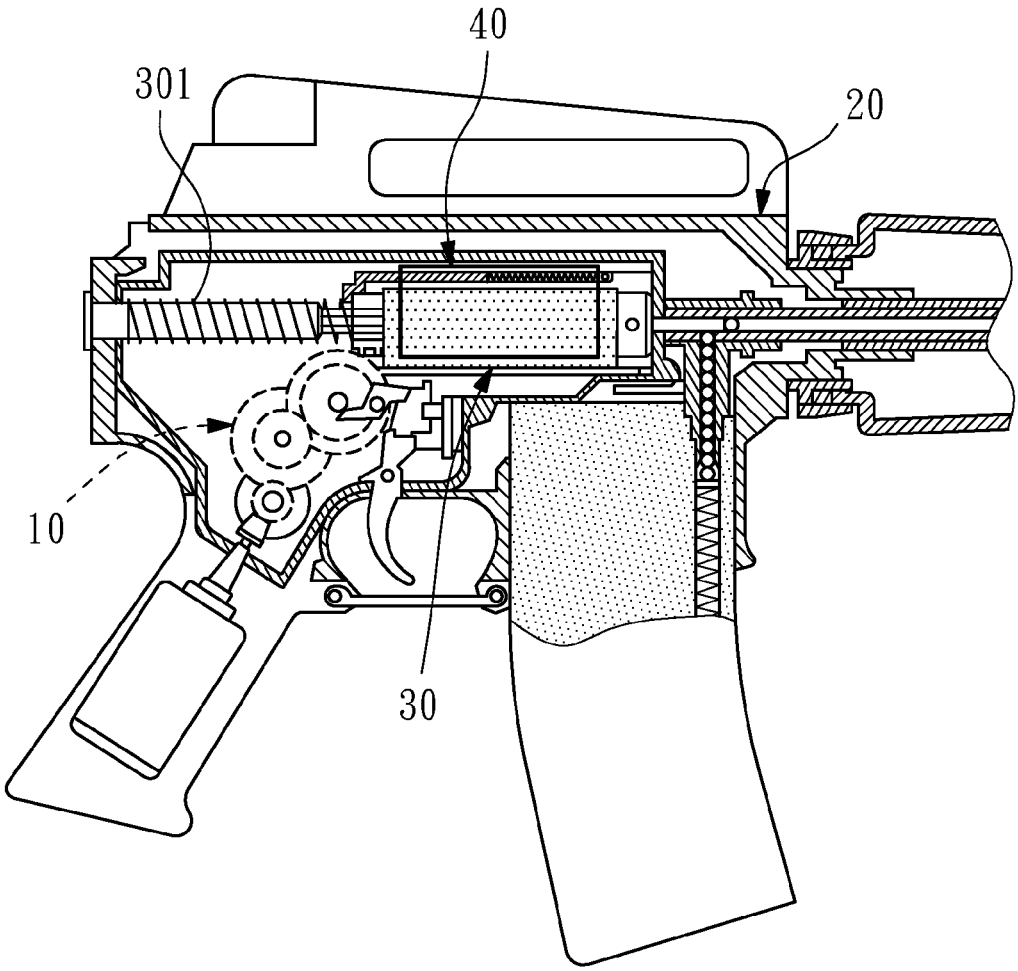
FIG. 2 (Prior Art)
FIG. 2 is a schematic sectional side view of another structure of toy gun with a de-arm mechanism according to the prior art.
Figure 3:
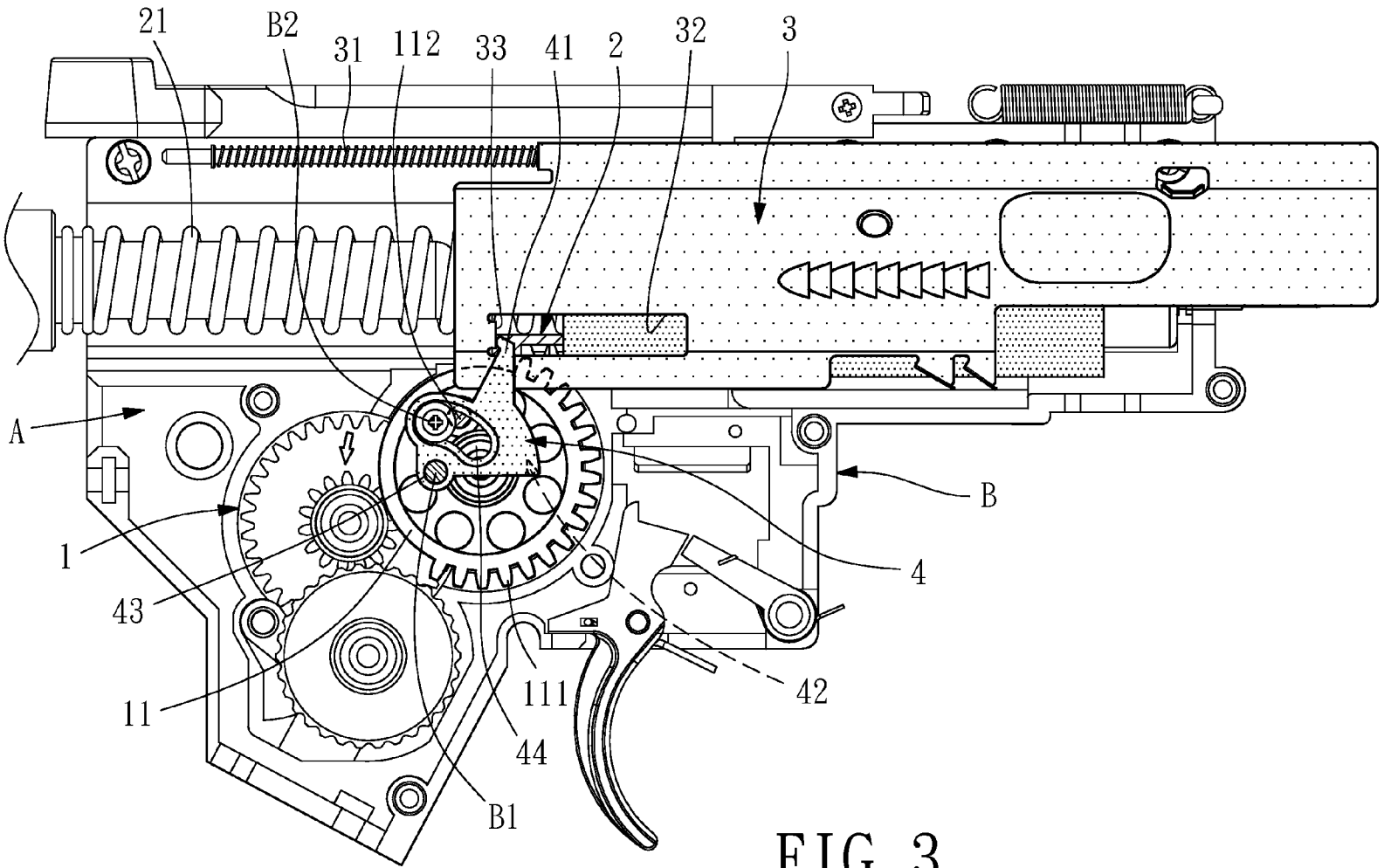
FIG. 3 is a schematic plain view showing a gun bolt transmission mechanism in an electric toy gun according to the present invention.

Referring to FIG. 3, a gun bolt transmission mechanism A is shown installed in the gun body B of an electric toy gun, comprising a gear set 1, a piston set 2, a bolt body 3 and a driving member 4.

The gear set 1 comprises a plurality of gears and a first gearwheel 11 driven to rotate by electricity (motor-driven). The first gearwheel 11 has a gear sector 111 disposed below the piston set 2 and adapted for moving the piston set 2 (see FIGS. 3~5), and a push rod 112 (see FIGS. 3~6).

The piston set 2 is mounted in the inside of the bolt body 3 and loaded with a first spring member 21 that imparts a forward returning pressure to the piston set 2.

The bolt body 3 is loaded with a second spring member 31 that imparts a forward returning pressure to the bolt body 3. Further, the bolt boy 3 has a side hole 32 and a driven portion 33 disposed in the side hole 32.

Figure 5:
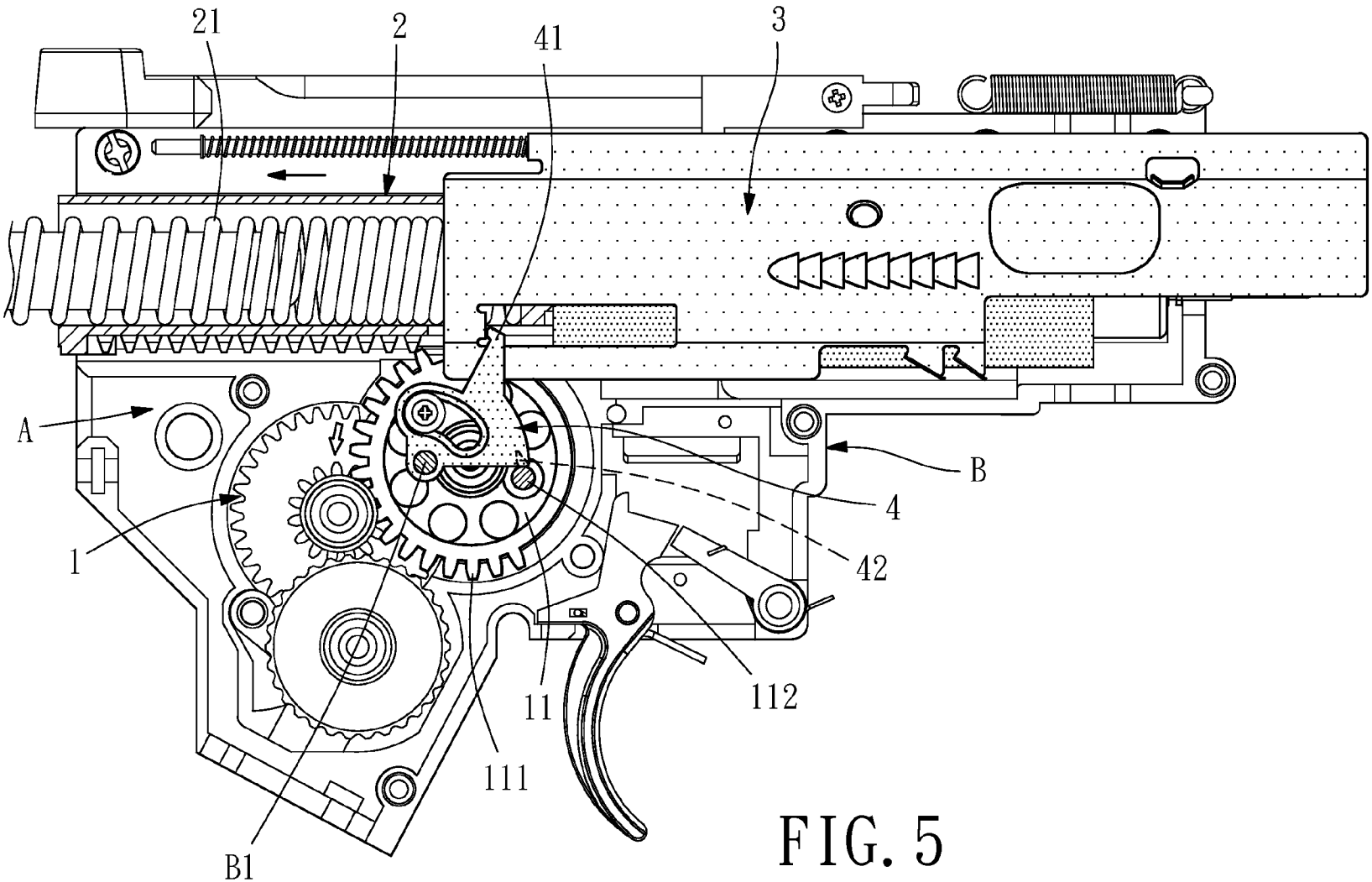
FIG. 5 corresponds to FIG. 3, showing the gun bolt transmission mechanism in action (II).
Figure 6:
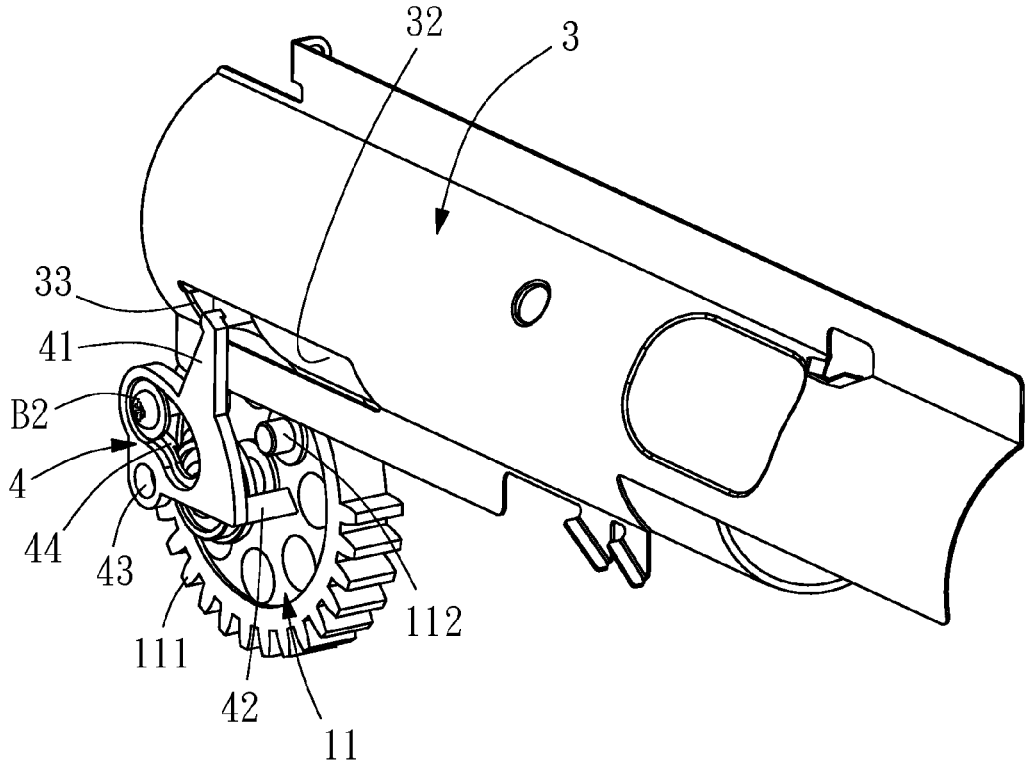
FIG. 6 is an elevational assembly view of the gun bolt transmission mechanism according to the present invention.
Figure 7:
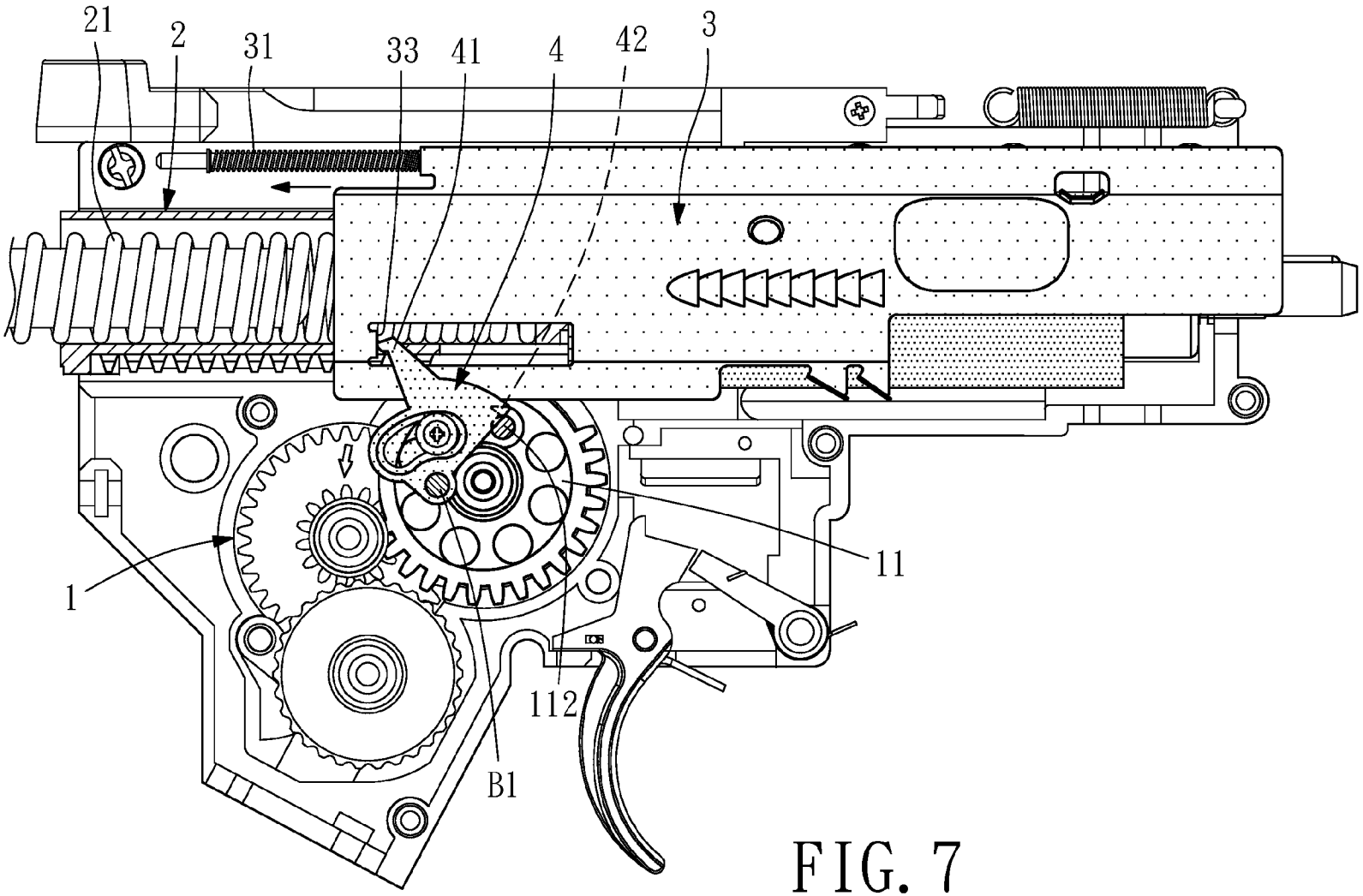
FIG. 7 is a schematic drawing of the present invention, showing the driving portion of the driving member stopped against the driven portion of the bolt body.
Figure 8:
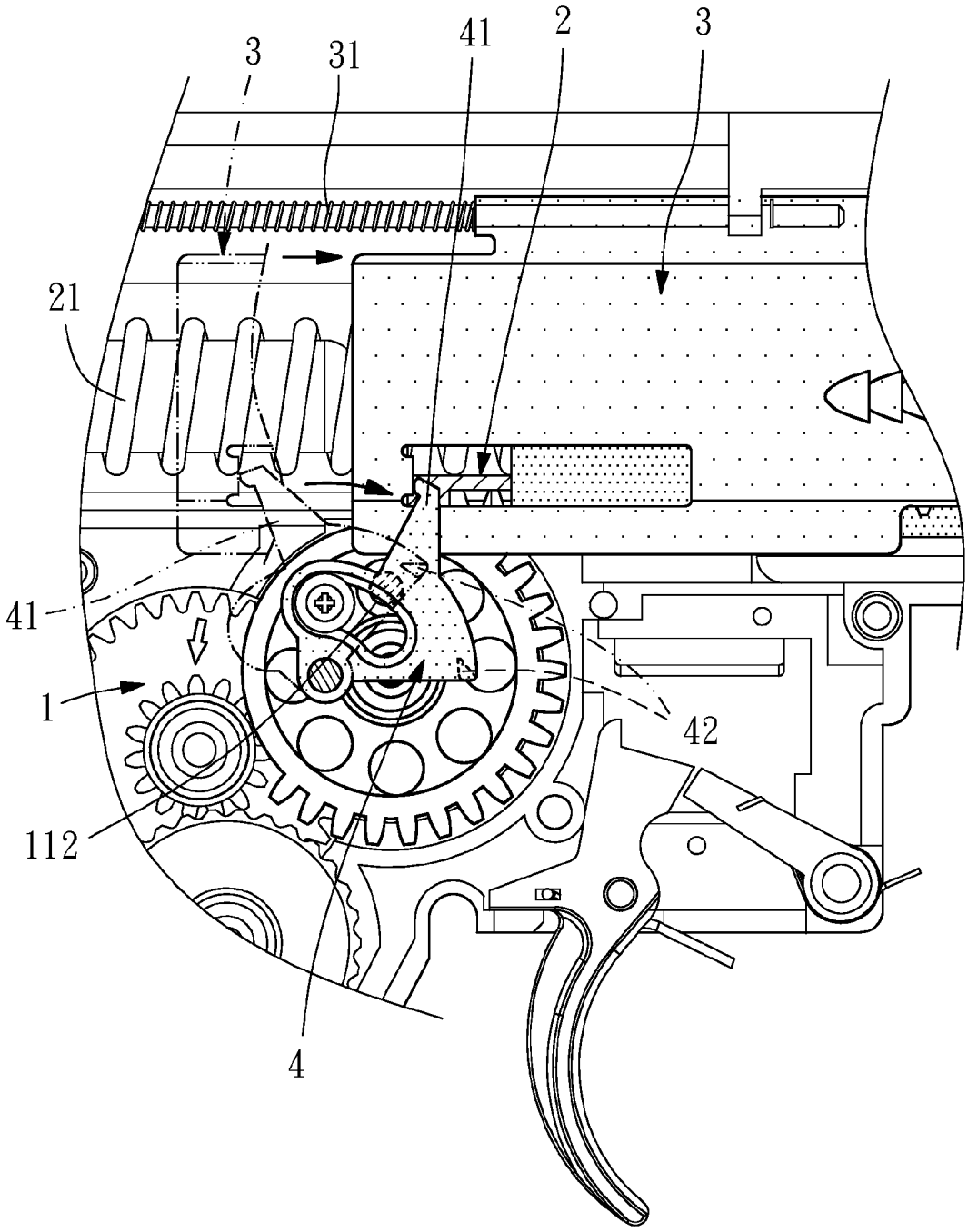
FIG. 8 is a schematic drawing of the present invention, showing the bolt body moved by the driving member and returned forwards after the extension portion of the driving member released from the push rod.
Figure 9:
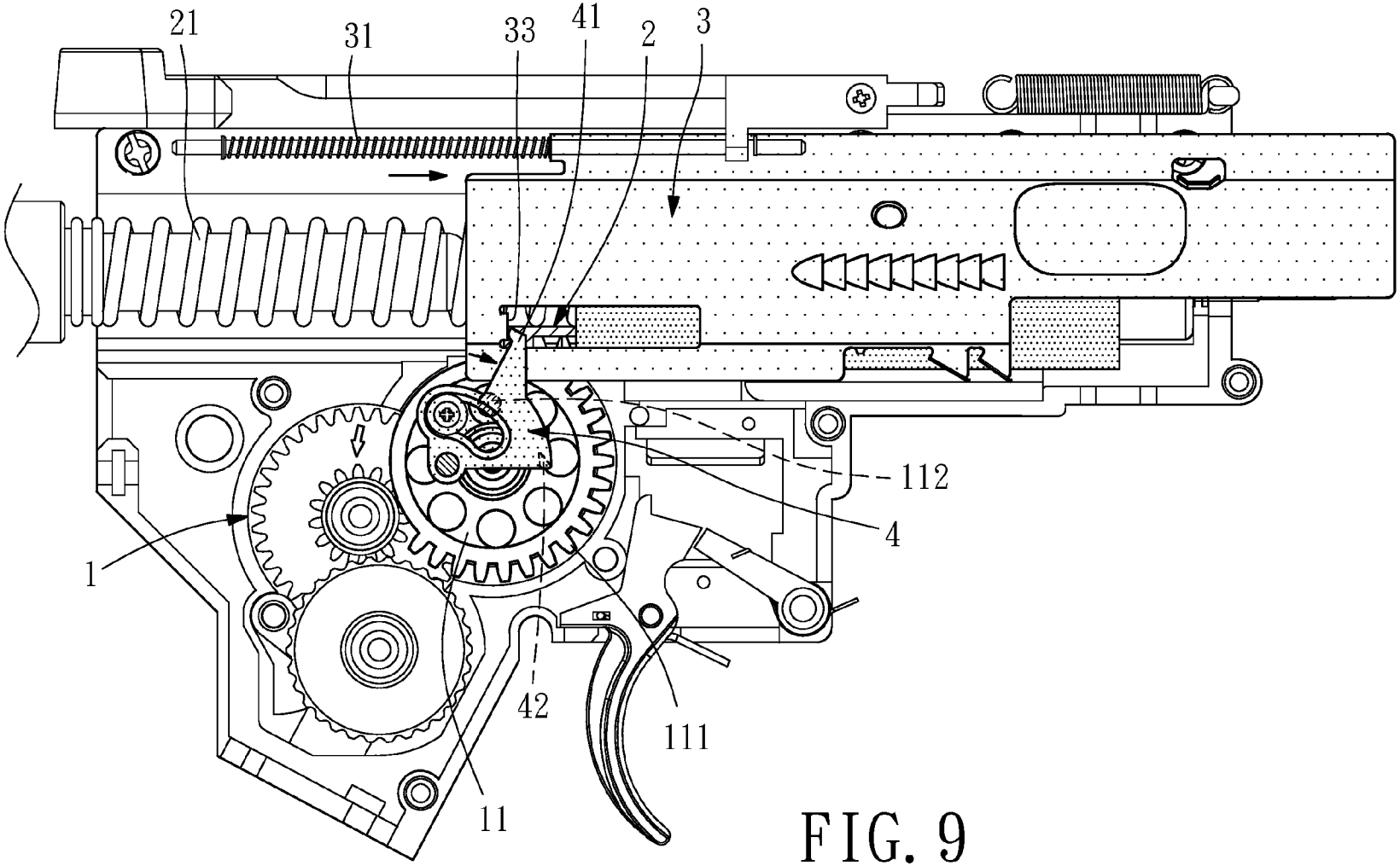
FIG. 9 is a schematic drawing of the present invention, showing the extension portion of the driving member released from the push rod of the first gearwheel.

The driving member 4 is pivotally connected to the inside wall of the gun body B, having a driving portion 41, an extension portion 42, a pivot hole 43 and an arched slot 44 (see FIG. 6). A pivot pin B1 (also see FIG. 3) is inserted through the pivot hole 43 and fixedly connected to the inside wall of the gun body B so that the driving member 4 can be turned about pivot pin B1. Further, a guide rod B2 is inserted through the arched slot 44 and fixedly connected to the inside wall of the gun body B to guide movement of the driving member 4 within a limited range corresponding to the arched slot 44 when the driving member 4 is turned about the pivot pin B1. After the gear set 1 has been rotated to the angle where the push rod 112 of the first gearwheel 11 pushes the extension portion 42 of the driving member 4 (see FIGS. 5 and 7), continuous rotation of the gear set 1 will cause the driving member 4 to be forced by the push rod 112 of the first gearwheel 11 to turn about the pivot pin B1 and therefore the driving portion 41 of the driving member 4 will push the driven portion 33 to move the bolt body 3 backwards. When the gear set 1 keeps rotating, the push rod 112 of the first gearwheel 11 will move over the extension portion 42 (see FIGS. 7 and 8), enabling the bolt body 3 to be returned to its former position by the second spring member 31 (see FIG. 9).

Figure 4:
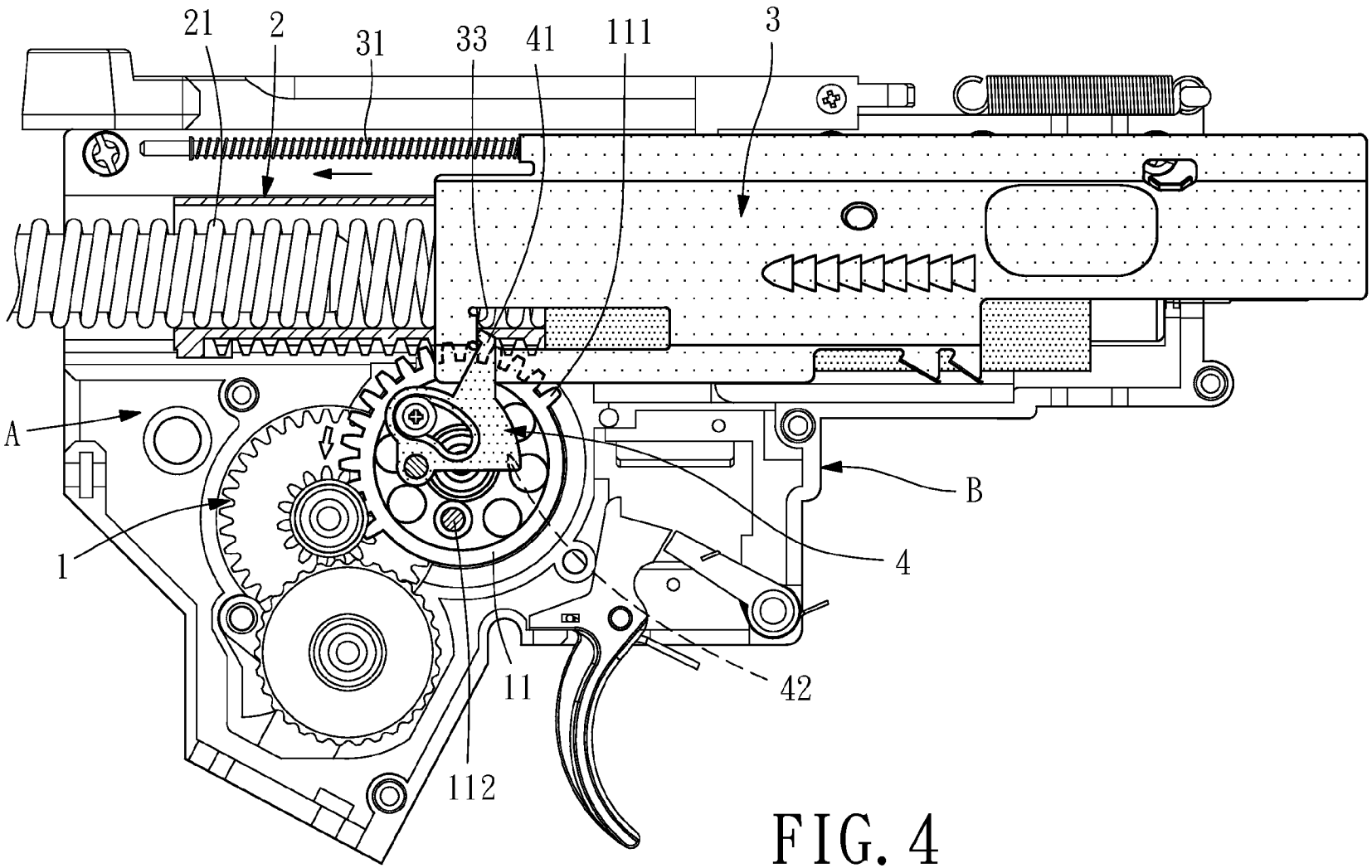
FIG. 4 corresponds to FIG. 3, showing the gun bolt transmission mechanism in action (I).

When the toy gun fires a bullet, the gear set 1 is rotated, and the gear sector 111 of the first gearwheel 11 moves the piston set 2 backwards (see FIGS. 3~5). After disengagement of the gear sector 111 of the first gearwheel 11 from the piston set 2, the piston set 2 moved by the first spring member 21 forwardly back to its former position (see FIGS. 5, 7 and 8). When the push rod 112 of the first gearwheel 11 touches the extension portion 42 of the driving member 4 during rotation of the gear set 1, the driving member 4 is forced to turn about the pivot pin B1 (see FIGS. 5 and 7). As soon as the driving portion 41 of the driving member 4 reaches the driven portion 33 of the bolt body 3, the bolt body 3 is pushed backwards till that the extension portion 42 of the driving member 4 is released from the push rod 112 of the first gearwheel 11 (see FIGS. 8 and 9). At this time, the bolt body 3 is pushed forwardly to its former position by the second spring member 31.

According to the aforesaid arrangement, there is no any linking relationship between the force to move the piston set 2 backwards and the force to move the bolt body 3 backwards, and therefore the piston set 2 will not be stopped at the front-most point and will not interfere with the return movement of the bolt body 3 to the front-most point. Thus, people viewing the gun body B can see that the bolt body 3 is accurately returned to its former position after each firing action (the gun body has a see-through portion through which people can see the bolt body) like the motion of the bolt body in a real gun.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A gun bolt transmission mechanism installed in a gun body of an electric toy gun, the gun bolt transmission mechanism comprising a gear set, a piston set, a bolt body and a driving member, said gear set being adapted for moving said piston set backwards, said gear set comprising a first gearwheel, said piston set being mounted in said bolt body and having loaded thereon a first spring member, said first spring member being adapted for returning said piston set after each backward movement of said piston set, said bolt body having loaded thereon a second spring member, said second spring member being adapted for returning said bolt body after each backward movement of said bolt body, wherein said bolt body has a driven portion; said driving member has a driving portion: said first gearwheel of said gear set has a push rod for moving said driving member for causing driving portion to push said driven portion and to further move said bolt body backwards during rotation of said first gearwheel and for enabling said bolt body to be returned forwardly by said second spring member when said first gearwheel is rotated to a predetermined angle where said push rod is disengaged from said driving member wherein said driving member has an extension portion movable by said push rod of said first gearwheel; said bolt body is returned forwardly by said second spring member when said push rod is disengaged from said extension portion after rotation of said first gearwheel to a predetermined angle and wherein said first gearwheel has a gear sector meshed with said piston set for moving said piston set and wherein said first gearwheel has a gear sector meshed with said piston set for moving said piston set wherein said driving member is pivotally connected to an inside wall of said gun body.

2. The gun bolt transmission mechanism as claimed in claim 1, wherein said driving member has a pivot hole pivotally connected to the inside wall of said gun body by a pivot pin, and an arched slot coupled to a fixed guide rod at the inside wall of said gun body for guiding rotary motion of said driving member about said pivot pin within a predetermined angle.

3. The gun bolt transmission mechanism as claimed in claim 2, wherein said bolt body has a side hole; said driven portion is disposed in said side hole of said bolt body.

* * * * *